US005622105A

United States Patent [19]

Bergman

[11] Patent Number: 5,622,105

[45] Date of Patent: Apr. 22, 1997

[54] HIGH-PRESSURE PRESS

[75] Inventor: Carl Bergman, Västerås, Sweden

[73] Assignee: Asea Brown Boveri AB, Västerås, Sweden

[21] Appl. No.: 525,556

[22] PCT Filed: Mar. 16, 1994

[86] PCT No.: PCT/SE94/00227

§ 371 Date: Sep. 19, 1995

§ 102(e) Date: Sep. 19, 1995

[87] PCT Pub. No.: WO94/21370

PCT Pub. Date: Sep. 29, 1994

[30] Foreign Application Priority Data

Mar. 19, 1993 [SE] Sweden ..... 9300915

[51] Int. Cl.[6] ..... B30B 1/32; B30B 15/28

[52] U.S. Cl. ..... 100/245; 100/269.05; 100/269.08; 100/269.18; 425/77; 425/DIG. 26

[58] Field of Search ..... 100/240, 245, 100/269.01, 269.05, 269.08, 269.09, 269.18, 269.19, 269.21; 425/77, 78, DIG. 26

[56] References Cited

U.S. PATENT DOCUMENTS

| | | | |
|---|---|---|---|
| 1,460,026 | 6/1923 | Madden | 100/269.01 |
| 1,782,103 | 11/1930 | Solberg et al. | 100/269.21 |
| 3,123,862 | 3/1964 | Levey, Jr. | 100/269.18 |
| 3,172,153 | 3/1965 | Loomis et al. | 425/DIG. 26 |
| 3,245,119 | 4/1966 | Huddleston | 425/77 |
| 3,635,616 | 1/1972 | Venkatesan | 100/269.08 |
| 4,081,984 | 4/1978 | Gustafsson et al. | 72/60 |
| 4,186,582 | 2/1980 | Johannisson et al. | 72/60 |
| 4,197,066 | 4/1980 | Kennedy | 425/77 |

FOREIGN PATENT DOCUMENTS

| | | | |
|---|---|---|---|
| 868736 | 2/1953 | Germany . | |
| 62-182587 | 8/1987 | Japan | 100/269.01 |
| 7807662 | 1/1980 | Sweden . | |

*Primary Examiner*—Stephen F. Gerrity
*Attorney, Agent, or Firm*—Burns, Doane, Swecker & Mathis, L.L.P.

[57] ABSTRACT

A high-pressure press is provided with a high-pressure chamber and an end member located at one end of the high-pressure chamber which serves as a packing holder. The end member is provided with a support surface which, under maximum pressure condition in the high-pressure chamber, faces an opposite end surface on the low-pressure cylinder which serves as a stationary part of the press. In this way, forces acting in a direction from the high-pressure chamber are transmitted to the stationary part when the support surface on the end member is brought into contact with the supporting end surface on the low-pressure cylinder.

16 Claims, 2 Drawing Sheets

FIG. 1
PRIOR ART
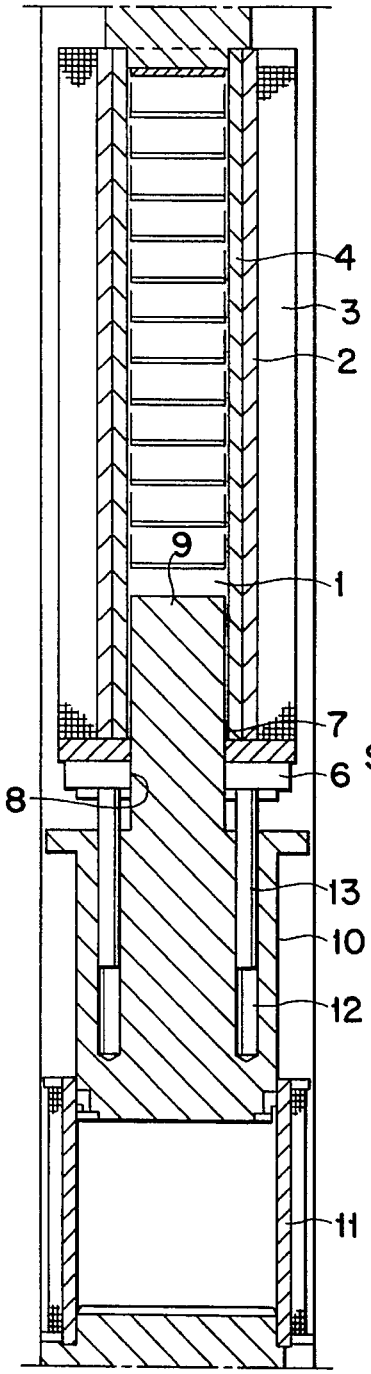
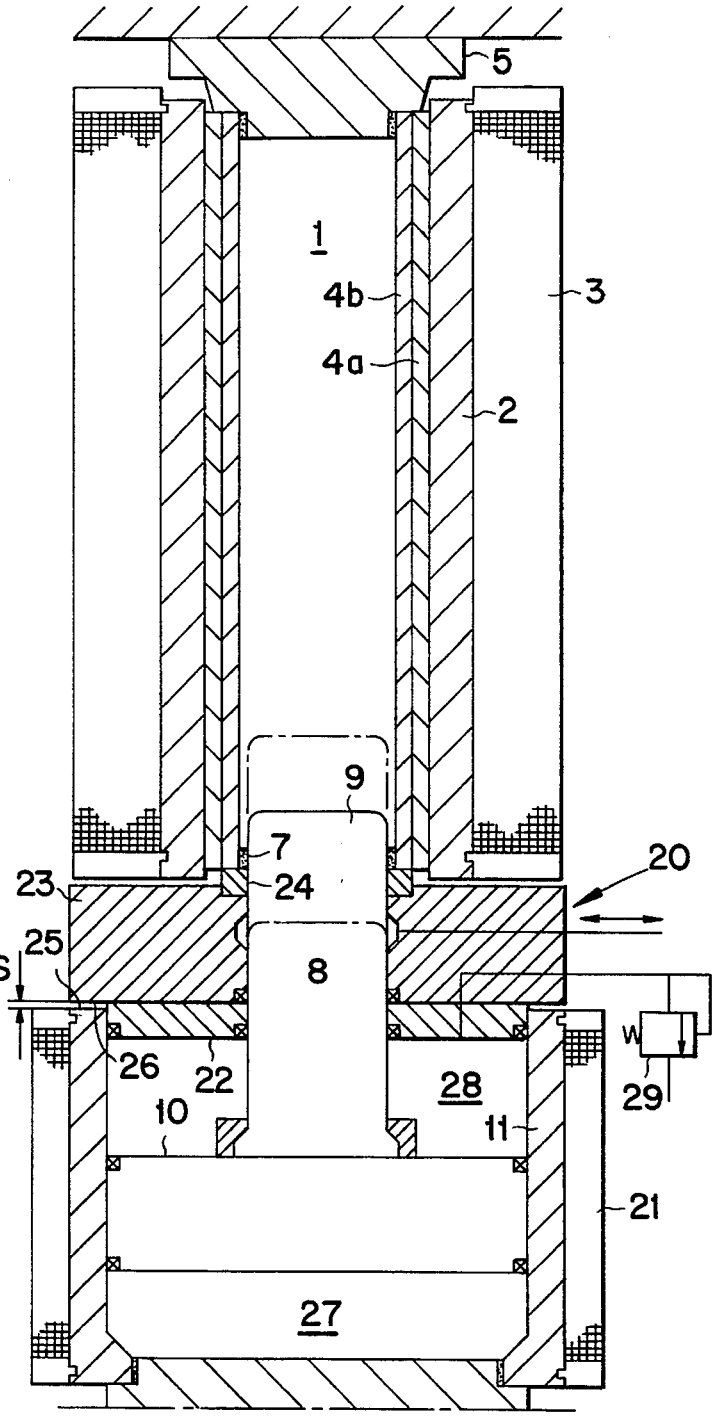
FIG. 2

HIGH-PRESSURE PRESS

FIELD OF THE INVENTION

The present invention relates to a high-pressure press, more specifically a high-pressure press; comprising a first cylinder element, at least one second cylinder element pressed into the first cylinder element, and a pair of end elements which together with the second cylinder element delimit a high-pressure chamber and of which one end element exhibits a cylinder bore, opening out into the high-pressure chamber, for a high-pressure piston and has parts which are movable to a limited extent in the axial direction and are adapted to form supports for the second cylinder element and a sealing device inserted between the second cylinder element and the high-pressure piston, the axially movable parts being loaded by hydraulic pressure in a direction towards the second cylinder element and the sealing device.

BACKGROUND OF THE INVENTION

High-pressure presses dimensioned for a pressure of up to 14,000 bar in the high-pressure chamber comprise, in a known embodiment, a thick-walled main cylinder of high-tensile steel, which is prestressed by means of several layers of prestressed steel wire wound around the cylinder, and a liner, which may be divided into an outer liner and an inner liner, pressed into the cylinder. In presses operating with such high pressures, very great demands are placed on the quality of the steel wall in the inner liner. The liner must be made with a view to preventing cracks in the inner wall surface. However, it is impossible to avoid that cracks pass which are so small that they cannot be detected with conventional crack detecting methods, but which in the long run, under the influence of the pressure variations during a number of work cycles, unavoidably extend to such an extent that the liner is finally split open and breaks into two parts.

When a pressure of the order of magnitude of 14,000 bar is allowed to act against the surfaces of fracture of the liner parts, the parts are subjected to enormous forces when, in principle, they are transformed into annular pistons. The force on one liner part can be taken up directly by the end member fixed against the liner by the press frame. As far as the other part is concerned, however, the conditions are different. In a known embodiment, the second end member, which serves as sealing or packing holder, is connected to a number of piston elements which are provided in evenly distributed axial cylinder bores in the low-pressure piston which generates the press force of the high-pressure piston. In the cylinder bores a cylinder pressure prevails, under the influence of which the packing holder end member balances the pressure on the packing exerted by the pressure in the high-pressure chamber. Since this end member also forms a support for one end of the liner, the liner fracture results in the force on the end member suddenly being multiplied. This force is transmitted via the piston elements to the low-pressure piston. The result is that heavy equipment, up to the order of magnitude of 5 tons, is moved approximately half a metre in one-thousandth of a second, which creates a powerful pressure shock in the whole hydraulic system and leads to the whole press being moved, whereby anchor bolts and connected hydraulic lines are torn off.

To avoid the dramatic consequences and the heavy costs which are connected with a liner fracture, the inner liner is regularly changed in good time before the expiry of the expected service life. Such preventive liner exchanges are costly and still do not completely solve the problems of liner fracture, since it has proved that about 10% of the liners are subjected to fracture within the expected safety margin as regards the number of work cycles.

SUMMARY OF THE INVENTION

The object of the present invention is to provide a high-pressure press of the kind stated in the introductory part of the description, which is so designed that the above-mentioned problems and costs which are connected with liner fractures can be eliminated and reduced, respectively.

This is achieved according to the invention in that the above-mentioned axially movable parts comprise an element with a support surface which is so adapted to a support surface on a stationary element that forces acting in a direction from the high-pressure chamber on the axially movable parts are transmitted to the stationary element when the support surface on the movable element is brought into contact with the support surface on the stationary element.

By transferring the force from the liner out to a stationary part in the case of liner fracture, according to the invention, which part is suitably an end member on the low-pressure cylinder of the press, instead of taking up the force by means of hydraulic shock absorbers in the low-pressure piston, according to the known method described above, a long movement path of heavy parts and strong pressure shocks in the hydraulic system can be avoided. The movement path of the movable end part need not, in principle, be longer than the maximum extension of the press, which, in practice, entails a movement path amounting to a maximum of 20 mm. In this context it has proved that damage to the press and to equipment connected thereto, such as anchoring devices and hydraulic lines, can be eliminated completely in case of a liner fracture.

BRIEF DESCRIPTION OF THE DRAWING FIGURES

The invention will be described in greater detail with reference to the embodiments shown in the accompanying drawings, wherein FIG. 1 schematically shows a longitudinal section through a known high-pressure press, and FIGS. 2 and 3, respectively, show corresponding longitudinal sections through an embodiment of a press according to the invention, FIG. 2 showing an intact press and FIG. 3 showing a press after a fracture has occurred on an inner liner.

DETAILED DESCRIPTION OF THE INVENTION

Figure 3:
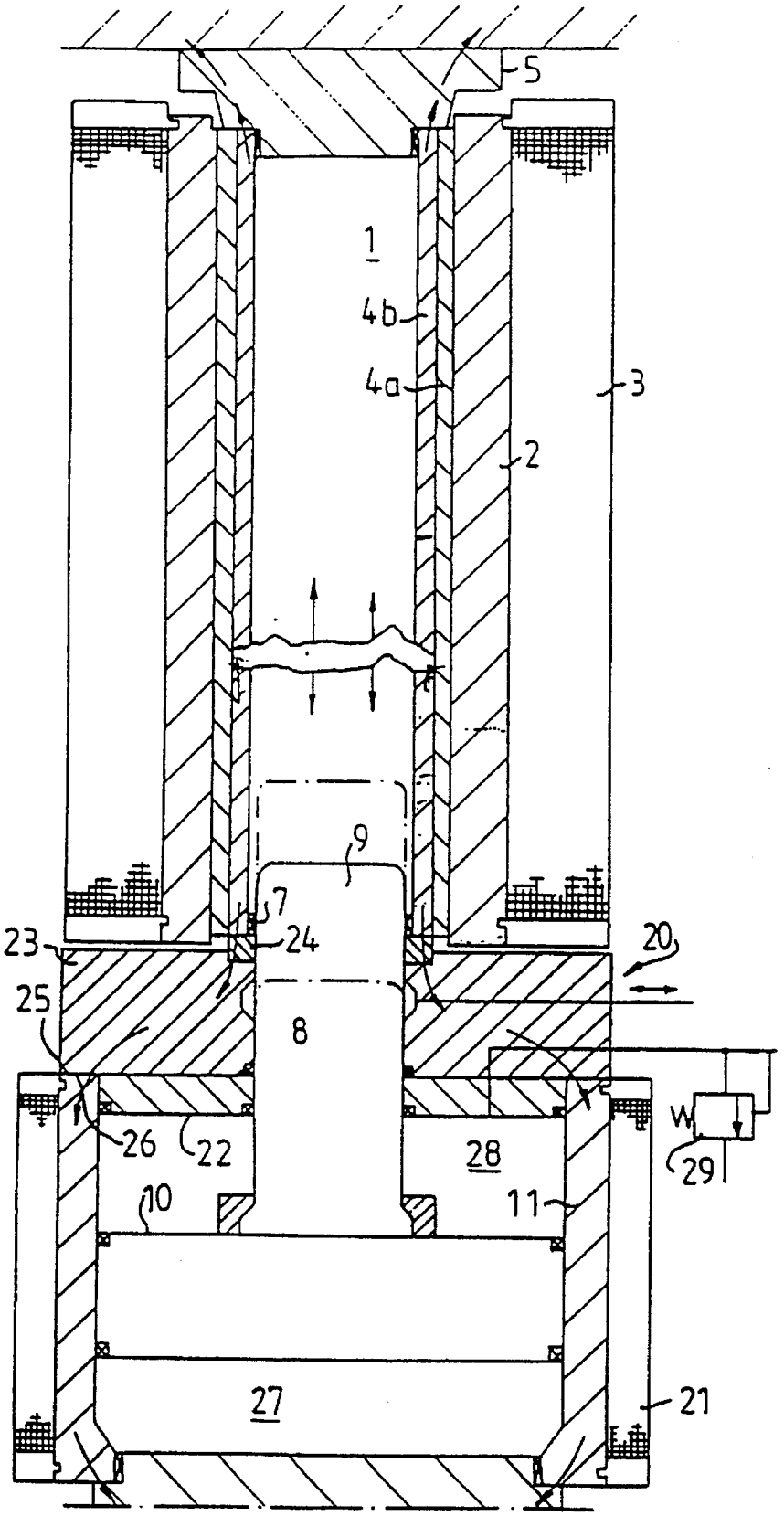

FIG. 1 shows a known high-pressure press, which has a high-pressure chamber 1 which is formed from an outer cylinder 2, a surrounding casing 3 of prestressed steel wire, an inner liner 4 pressed into the cylinder, an upper end member, and a lower end member 6 which serves as a packing holder for a packing 7. The end member 6 is formed with a cylinder bore 8 for a high-pressure piston 9, which is made integral with a low-pressure piston 10 in a low-pressure cylinder 11. The piston 10 exhibits a plurality of evenly distributed cylinder bores 12, in which piston elements 13 connected to the end member 6 are provided. The force from a cylinder liner part is transmitted, in case of a liner fracture, to the low-pressure-piston 10 via the piston elements 13, which results in the low-pressure piston 10 reversing a distance of about half a metre in a fraction of a second with the consequences described above.

FIGS. 2 and 3 show a high-pressure press according to the invention. In the same way as the prior art press described above, it has a high-pressure chamber 1, which is formed from an outer cylinder 2, a surrounding casing 3 of prestressed steel wire, a liner pressed into the cylinder and divided into an outer liner 4*a* and an inner liner 4*b*, an upper end member 5 and a lower end member generally designated 20, which serves as a packing holder for a packing 7. The end member 20 is formed with a cylinder bore 8 for a high-pressure piston 9, which is formed integral with a low-pressure pressure piston 10 in a low-pressure cylinder 11 with a casing 21 of several turns of prestressed steel wire.

In the embodiment shown, the end member consists of a piston element 22 movably journalled in the low-pressure cylinder 11, a cylindrical wall element 23 which makes contact with the piston element 22 and has a larger diameter than the piston element 22, and a retaining ring 24, with which the packing 7 and the outer and inner liners 4*a* and 4*b*, respectively, make contact, but the piston and wall elements 22, 23 can also be formed integral with each other.

In a known manner, the low-pressure cylinder 11 is fixed in a press frame, resting on a press foundation and not further shown, and thus constitutes a stationary part of the press. That end surface 25 of the cylinder 11 which faces the end member 20 is formed as a stop or support surface for an opposite surface 26 on the wall element 23 of the end member.

The maximum operating pressure in the high-pressure chamber 1, for example 14,000 bar, is attained at a pressure in the chamber 27 of the low-pressure cylinder 11 which amounts to about 10% of the pressure in the high-pressure chamber, that is, about 1400 bar in the example described. In the chamber 28 of the low-pressure cylinder, on the side of the end member, a pressure is maintained which is approximately 25% of the pressure in the chamber 27, that is, about 350 bar, by means of a pressure-regulating valve 29. FIG. 2 shows the press in intact form with a maximum pressure in the pressure chamber 1. The support surface 26 of the wall element 23 is here located at a distance "S" from the end surface 25 of the cylinder 11. In practice, this distance does not exceed 20 mm and corresponds to the elongation to which the press is subjected when the pressure in the high-pressure chamber rises from a minimum to a maximum.

If the inner liner 4*b* were to burst because of cracking, as illustrated in FIG. 3, the pressure in the pressure chamber 1 would act against the fractured surfaces of the liner parts, in which case the liner parts would be exposed to very great oppositely directed forces. The force from the upper part of the liner 4*b* is taken over by the upper end member 5, which is fixed by the press frame, whereas the force from the lower part of the liner 4*b* is transmitted to the end member 20 which is then pressed downwards until the support surface 26 of the wall element 23 hits the support surface 25 on the cylinder. In this way, the force is transferred out into the low-pressure cylinder 11 and further out into the press frame after a very short movement of the end member 20, as illustrated by the arrows.

It has proved that damage to the press and the associated equipment in case of a liner fracture can be completely eliminated in this way, which in turn means that a liner exchange for preventive purposes does not have to be carried out. The press can quite simply be utilized up to the point where a liner fracture occurs. This permits considerable savings to be made. Among further advantages which can be obtained by using a press according to the invention, as compared with the described prior art press, may be mentioned a shortening of the press by about 2 metres and a simplification of the hydraulics, since hydraulic fluid with a high pressure need not be supplied to any movable parts (cf. the cylinder bores in the low-pressure cylinder of the prior art press).

I claim:

1. A high-pressure press, comprising a first cylinder element, at least one second cylinder element pressed into the first cylinder element, a stationary part having a support surface, and a pair of end elements which together with the second cylinder element delimit a high-pressure chamber, one of the end elements forming a support for the second cylinder and being provided with a cylinder bore opening into the high-pressure chamber, the cylinder bore receiving a high-pressure piston that is movable in an axial direction, a sealing device disposed between the second cylinder element and the high pressure piston, the one end element including axially movable parts which are movable to a limited extent in the axial direction, the axially movable parts being loaded by hydraulic pressure in a direction towards the second cylinder element and the sealing device, said axially movable parts comprising a first movable part having a support surface which is positioned relative to the support surface on the stationary part so that forces acting in a direction from the high-pressure chamber on the axially movable parts are transmitted to the stationary part when the support surface on the first movable part makes contact with the support surface on the stationary part.

2. A high-pressure press according to claim 1, wherein said stationary part includes a low-pressure cylinder, said axially movable parts also including a piston element which is axially displaceable in the low-pressure cylinder.

3. A high-pressure press according to claim 2, including a low-pressure piston journalled in the low-pressure cylinder, the low-pressure piston being connected to the high-pressure piston, a first cylinder space disposed on one side of the low-pressure piston between the low-pressure piston and the piston element, and a second cylinder space disposed on an opposite side of the low-pressure piston, and a pressure-regulating device connected to the first cylinder space for maintaining a pressure in the first cylinder space which is lower than the pressure in the second cylinder space.

4. A high-pressure press according to claim 3, wherein the piston element makes contact with the first movable part, the support surface of the first movable part being located opposite to an end surface of the low-pressure cylinder, the end surface of the low-pressure cylinder facing in the direction of the high-pressure chamber.

5. A high-pressure press according to claim 4, wherein the piston element is formed integral with the first movable part, the first movable part having a surface located opposite to an end surface of the low-pressure cylinder, the end surface of the low-pressure cylinder facing in the direction of the high-pressure chamber.

6. A high-pressure press according to claim 5, the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

7. A high-pressure press according to claim 4, the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

8. A high-pressure press according to claim 3, wherein the piston element is formed integral with the first movable part, the first movable part having a surface located opposite to an end surface of the low-pressure cylinder, the end surface of the low-pressure cylinder facing in the direction of the high-pressure chamber.

9. A high-pressure press according to claim 8, the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

10. A high-pressure press according to claim 3, the support surface on the first movable part and the support surface on the stationary part are disposed so that at maximum pressure in the high-pressure chamber, the Support surface on the first movable part and the support surface on the stationary part lie at a distance from each other which is at least substantially equal to elongation of the press at maximum pressure.

11. A high-pressure press according to claim 2, wherein the piston element makes contact with the first movable part, the support surface of the first movable part being located opposite to an end surface of the low-pressure cylinder, the end surface of the low-pressure cylinder facing in the direction of the high-pressure chamber.

12. A high-pressure press according to claim 11, the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

13. A high-pressure press according to claim 2, wherein the piston element is formed integral with the first movable part, the first movable part having a surface located opposite to an end surface of the low-pressure cylinder, the end surface of the low-pressure cylinder facing in the direction of the high-pressure chamber.

14. A high-pressure press according to claim 13, the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

15. A high-pressure press according to claim 2, wherein the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

16. A high-pressure press according to claim 1, wherein the support surface on the first movable part and the support surface on the stationary part are disposed so that at maximum pressure in the high-pressure chamber, the support surface on the first movable part and the support surface on the stationary part lie at a distance from each other which is at least substantially equal to elongation of the press at maximum pressure.

* * * * *